US005749822A

United States Patent [19]

Ellsworth et al.

[11] Patent Number: 5,749,822

[45] Date of Patent: May 12, 1998

[54] GUSSET FOLDING MECHANISM AND METHOD FOR PLASTIC BAG MAKING MACHINE

[75] Inventors: William D. Ellsworth, Fairport; David Z. Dike, Port Gibson; David I. Laber, Victor, all of N.Y.

[73] Assignee: Proven Designs, Inc., Palmyra, N.Y.

[21] Appl. No.: 617,251

[22] Filed: Mar. 18, 1996

[51] Int. Cl.[6] ..... B31B 17/26; B31B 23/00

[52] U.S. Cl. ..... 493/248; 493/254; 493/439

[58] Field of Search ..... 493/177, 178, 493/243, 248, 258, 405, 410, 416, 417, 436–440, 446–448, 451, 455, 456, 475, 476, 478, 254

[56] References Cited

U.S. PATENT DOCUMENTS

| | | | |
|---|---|---|---|
| Re. 26,062 | 7/1966 | Ahlbrandt | 493/416 X |
| 4,047,711 | 9/1977 | Gregoire et al. | 493/248 |
| 4,578,051 | 3/1986 | Everman | 493/439 X |
| 5,147,278 | 9/1992 | Demura et al. | 493/443 X |

*Primary Examiner*—Jack W. Lavinder
*Assistant Examiner*—Anthony Ojini
*Attorney, Agent, or Firm*—Shlesinger, Fitzsimmons & Shlesinger

[57] ABSTRACT

In a bag making machine the longitudinal side edges and adjacent portions of an elongate plastic web, which is folded in half medially of its centerline, pass from a set of inlet rolls over and under, respectively, a pair of vertically spaced separating rolls before merging at a set of outlet rolls. The separating arms extend inwardly between the two separated portions of the web only part way toward the fold line, and are spaced apart exactly twice the depth of the gusset that is to be formed. The remaining portions of the web, which are bisected by the folded line, are disposed in a vertical plane transverse to the separating arms, and upon traveling from the arms to the outlet rolls are folded inwardly between the merging portions of the web by the inner, pointed end of a triangularly shaped plow, which engages and progressively urges the fold line inwardly to the desired gusset depth The separating arms are vertically adjustable relative to each other; and the plow is adjustable transversely of the fold line of the web selectively to adjust the depth of the gusset.

13 Claims, 4 Drawing Sheets

GUSSET FOLDING MECHANISM AND METHOD FOR PLASTIC BAG MAKING MACHINE

BACKGROUND OF THE INVENTION

This invention relates to machines for manufacturing plastic bags, whether the plastic is a homogeneous sheet, a lamination, or a coextrusion. More particularly this invention relates to an improved gusset folding method, and a mechanism that is incorporated in a plastic bag making machine to form in a plastic bag a gusset which can be used as a simple gusset or can be processed to form the basis of a stand pouch type bag.

In bag making machines of the type described, including for example machines which make plastic bags having thereon so-called zipper elements which permit one end of the bag repeatedly to be opened and closed, it is often desirable to form in the opposite end of the bag, the end which is permanently closed, a gusset or folded portion of the bag which extends inwardly of the bottom of the bag. In such machines a long strip or web of plastic film, which is folded in half about its longitudinal axis, is passed intermittently or continuously through the machine with the closed or folded web of the strip positioned adjacent one side of the machine, and with the separable, registering, longtitudinal side edges of the web facing the other side of the machine. As the folded web is advanced through the machine the two layers of the folded material are momentarily spread apart and the folding member extends between the two layers along their fold line, thus causing portions of the two layers at opposite sides of the fold line to be folded slightly inwardly between the two layers, thus forming a gusset between the two folds.

Among the problems heretofore encountered with gusset folding mechanisms of the type described is that the member that effects the folding of the gusset into the closed end of the bag does not always register properly with the fold line, and also creates undesirable wrinkles in the bag material. One such mechanism, for example, comprises a pair of spaced, parallel plates for guiding in a web path the folded film that is to form the bag. As the folded film passes the guide plates, portions of the film at opposite sides of its fold line are engaged and urged into the space between the guide plates by the periphery of a wheel or disc, which is mounted to rotate adjacent the guide plates. The problem with such mechanism is that it is extremely difficult to effect any adjustment thereof to increase or decrease the depth of the gusset which is formed in the bag making film; and also, portions of the bag which overlap opposed end surfaces of the rotating folding member tend to become pinched or wrinkled between the folding member and the overlapping guide plates.

A more specific problem with traditional methods of forming the gusset is that the geometry of the folder mechanism does not allow for a true and consistent web path of all parts of the film as it advances through the gusset forming mechanism. As a result, wrinkles are introduced into the film.

One primary object of this invention therefore, is to provide a geometrically accurate method of forming the gusset into the folded end of a plastic web.

It is an object also of this invention, therefore, to provide for bag making machines of the type an improved gusset forming mechanism which obviates the problems previously encountered with prior art gusset folding mechanisms.

More specifically, it is an object of this invention to provide an improved mechanism of the type described which permits very accurate separation and folding of selected portions of a folded web of bag making film, thereby to produce improved, wrinkle-free gussets in the film.

Other objects of the invention will be apparent from the specification and the recital of the appended claims, particularly when read in conjunction with the accompanying drawings.

SUMMARY OF THE INVENTION

The device that comprises this invention is installed into a machine that utilizes a folded plastic web. The folded plastic web advances through the machine either intermittently or continuously. Initially, the folded plastic web is folded approximately in half along its longitudinal axis with the fold at one edge. As the web enters the gusseting device, it first passes between a set of inlet rolls which act to hold the two halves of the web together and in registry. On the exit side of the mechanism a similar set of outlet rolls also act to hold the two halves of the now-gusseted web together. Between these two sets of rolls are two vertically spaced and vertically adjustable web separating arms which spread the two halves of the web apart. Thus, the upper half of the incoming folded web goes up over the upper arm and then goes back down to its original level at the outlet rolls, while the lower half of the folded web goes under the lower arm and then back up to its original level. These two arms extend inwardly from the side of the mechanism remote from the fold line, and are spaced apart exactly twice the depth of the final gusset to be formed. Also, the arms are not inserted between the two halves of the folded web all the way to the bottom of the fold. Rather, they extend to a depth short of the fold by a distance equal to the depth of the final gusset to be formed.

Thus, as the two halves of the folded web are spread apart, there is sufficient material not supported by the two arms to allow the upper and lower halves to be separated without stresses, strain, or distortion. At this point, a cross section through the apex of the two separation arms would show a generally U-shaped web with the top and bottom halves of the folded plastic sheet being separated by twice the depth of the final gusset and a vertical section of the folded web connecting the top and bottom halves at one side. The web is able to flow into this configuration without distortion from its original folded configuration. At this point, the top and bottom halves of the folded web descend to the exiting rollers and come together. As this is occurring, a plow is inserted into the vertical section of the web that has been created in the previous steps. This plow pushes the vertical section of the web between the upper and lower sections of the web, thus forming a gusset. Again, this is done without wrinkles or stresses on the material.

THE DRAWINGS

DETAILED DESCRIPTION OF THE PREFERRED EMBODIMENTS

Figure 1:
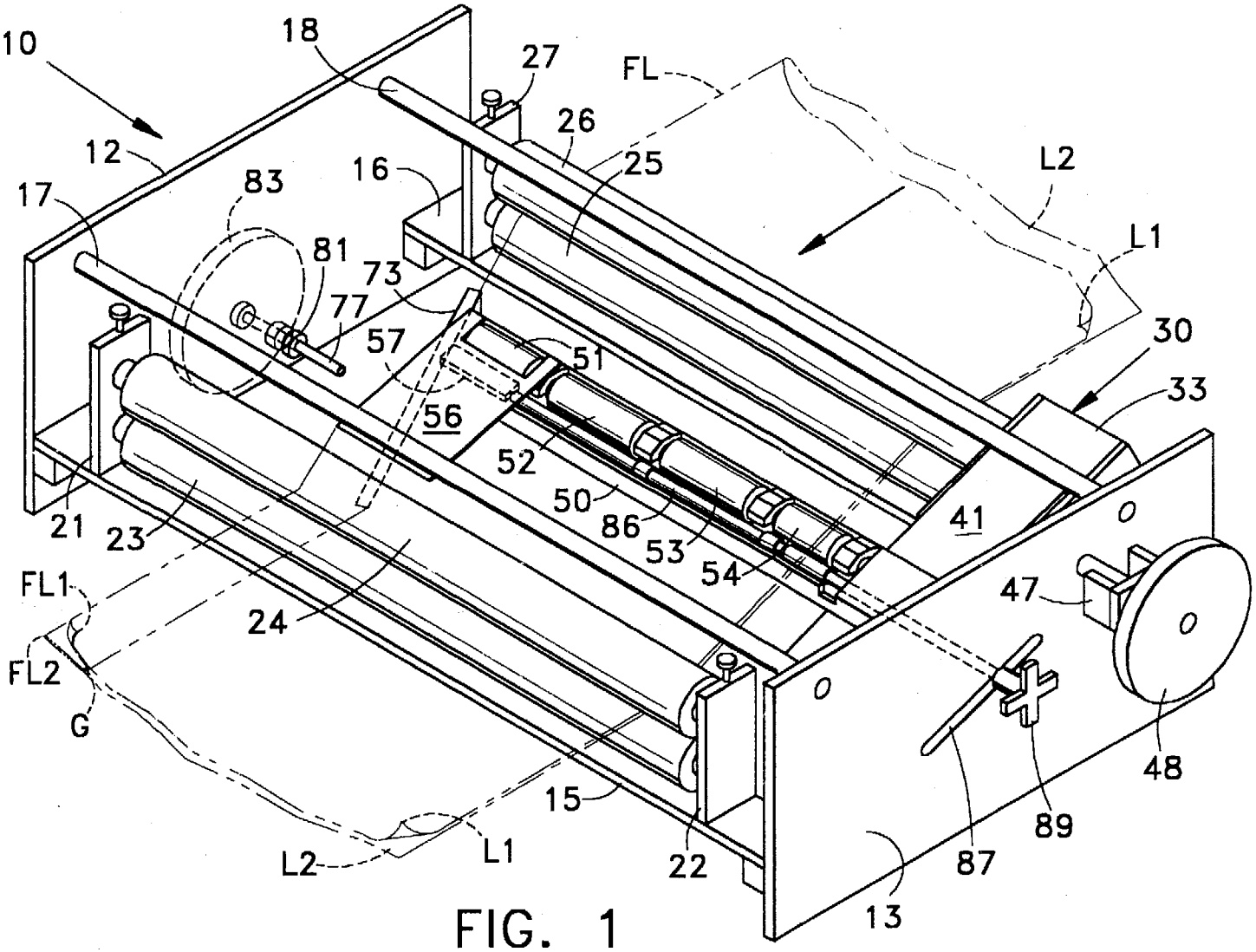
FIG. 1 is a fragmentary perspective view of an improved gusset folding mechanism made according to one embodiment of this invention, the mechanism being shown as it appears when mounted in a bag making machine, and a folded sheet or film of plastic bag making material being shown in phantom by broken lines as it appears when passing through the gusset folding mechanism.

Referring now to the drawings by numerals of reference, 10 denotes generally an improved gusset folding mechanism made according to one embodiment of this invention, and comprising a pair of spaced, parallel sidewalls 12 and 13 that are disposed to be secured in the frame of a plastic bag making machine intermediate the ends thereof. An elongate strip of plastic film, which is shown in phantom by broken lines in the drawings, and which is folded medially of its centerline about fold line FL into two overlapping layers L1 and L2, is disposed to travel continuously or intermittently through mechanism 10 in the direction of the arrow shown in FIG. 1. The walls 12 and 13 are secured in spaced, parallel relation to each other in part by a pair of spaced, parallel, roll-supporting straps 15 and 16, which are secured at opposite ends thereof adjacent the outlet and inlet ends, respectively, of mechanism 10 to the inside surfaces of plates 12 and 13 adjacent the lower corners thereof. Also, a pair of spaced, parallel stiffener rods 17 and 18 are secured at opposite ends thereof to the inside surfaces of endwalls 12 and 13 adjacent the upper corners thereof.

Rotatably journaled at opposite ends thereof in a pair of rectangularly-shaped brackets 21 and 22 that project upwardly from plate 15 adjacent opposite ends thereof are two outlet rolls 23 and 24. A like pair of inlet rolls 25 and 26 are rotatably journaled at its opposite ends thereof in spaced, parallel brackets 27 and 28, which are fixed to or project vertically upwardly from the other roll supporting strap 16 adjacent opposite ends thereof.

Numeral 30 denotes generally a wedge-shape gear box which is mounted on sidewall 13 adjacent the inside surface thereof to extend in the space between the two pairs of rolls 23, 24 and 25, 26, respectively. Box 30, which is shown more clearly in FIG. 3, is triangular in cross section. It has a plane, vertically disposed rear or base surface 32 (FIGS. 2 and 3) which is disposed in spaced, confronting relation to the roll supporting plate 28, and upper and lower guide surfaces 33 and 34, respectively, which extend from rear surface 32 toward the outlet rolls 23 and 24, and which are inclined toward each other in such manner that they intersect at a pointed edge 36 that registers with and is spaced slightly rearwardly (to the right in FIG. 3) of the nip formed between the rolls 23 and 24.

Slidably mounted on the surfaces 33 and 34 of the gear box 30 for adjustment toward and away from the pointed end 36 of the box are upper and lower wing supporting mounts or members 41 and 42, respectively. Gear racks 43 and 44, which are secured to the undersides of the members 41 and 42, respectively, have their teeth connected by a gear train, shown in phantom by broken lines in FIG. 3, in box 30 to the inner end of an operating shaft 46. Shaft 46 is journaled intermediate its ends by a bracket 47 (FIGS. 1 and 2) to rotate in an opening in wall 13 in such manner that the inner end of the shaft is drivingly engaged with the gear train in box 30, and the outer end of the shaft has secured thereto a knob 48 for manually rotating the shaft 46 selectively in opposite directions simultaneously to adjust the wing supporting members 41 and 42 selectively toward or away from the pointed end 36 of the gear box 30. The gear train in box 30 is of conventional design and therefore has not been described in detail herein.

Figure 2:
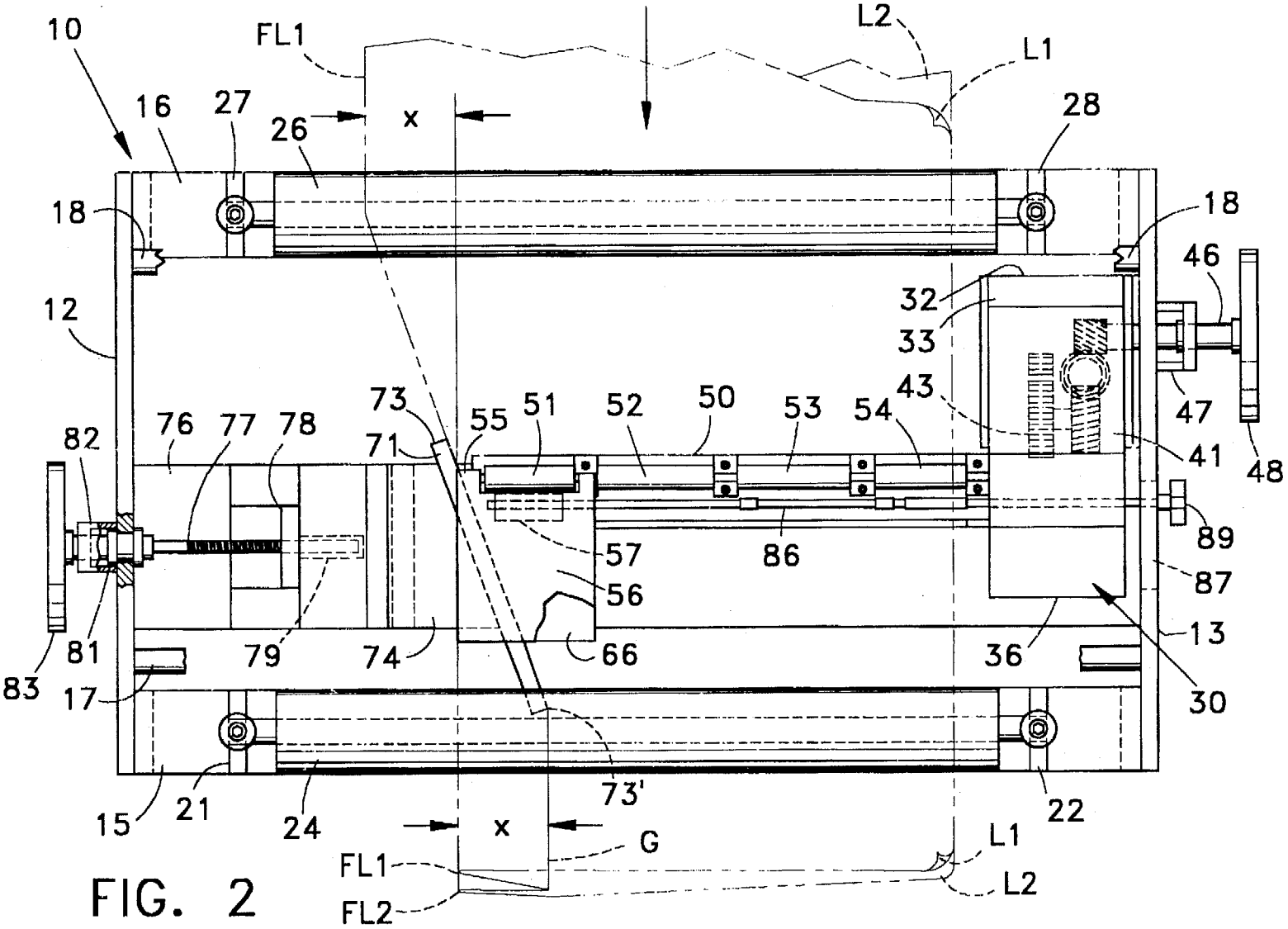
FIG. 2 is a fragementary planview of this mechanism with portions thereof cut away and shown in section.
Figure 3:
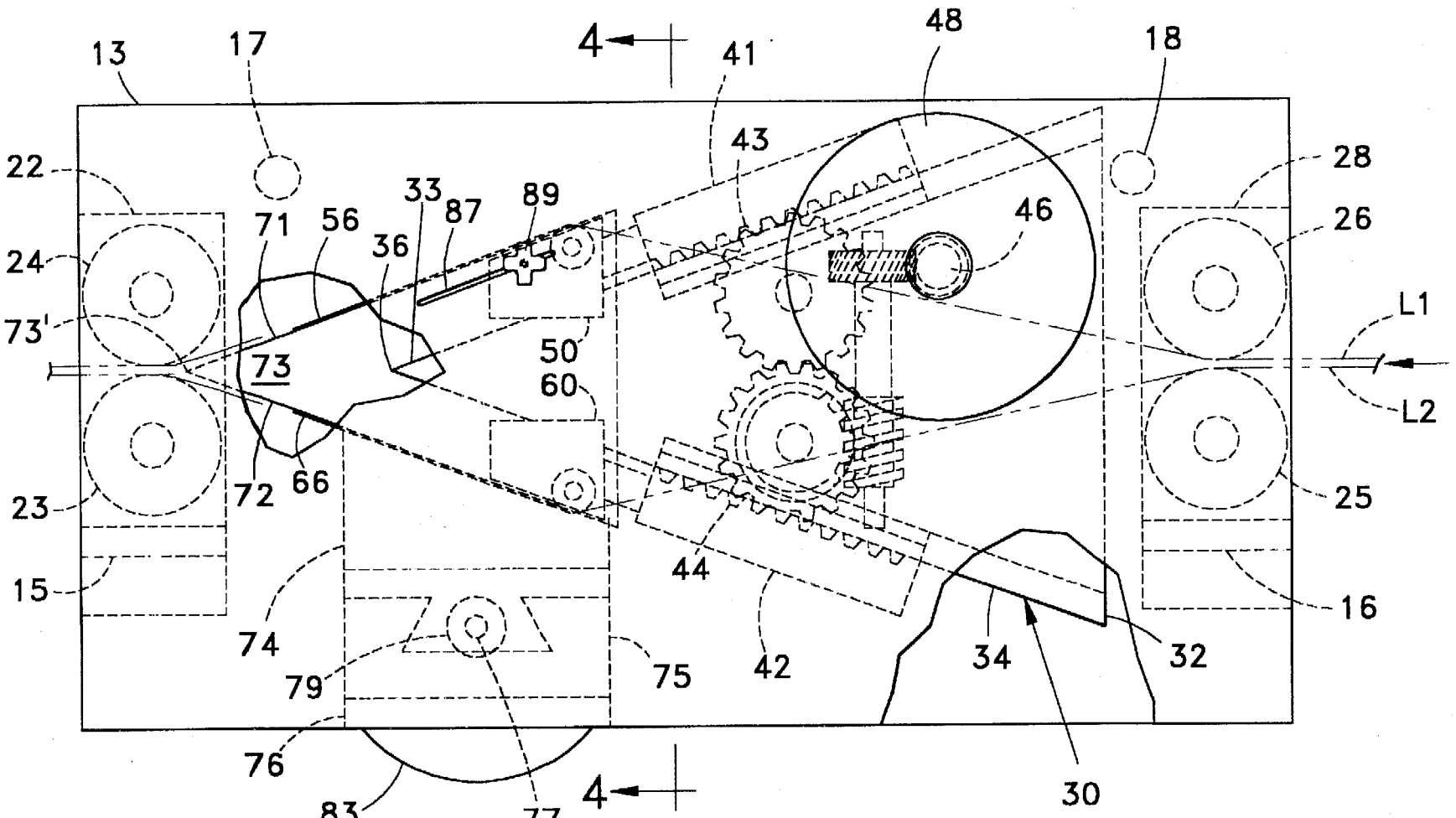
FIG. 3 is a slightly enlarged end elevational view of the mechanism as seen when looking at the right side thereof as shown in FIG. 1, and with portions thereof broken away.

Secured at one end thereof (the right end as shown in FIG. 2) to the inside surface of the upper wing supporting member 41 (the side thereof remote from wall 13) is an upper wing member 50, which projects at right angles from member 41 horizontally and in cantilever fashion part way across the space separating the sidewalls 12 and 13. Rotatably mounted at opposite ends thereof in registering recesses in the upper surface of the wing member 50 are four coaxially disposed film guiding rollers 51,52, 53 and 54. At its end remote from support member 41 the upper wing member 50 has mounted thereon a large, rectangular, sheet metal wing element 56, which is secured adjacent its upper, furcated end to an adjusting block 57 that is mounted for limited sliding movement in a recess in member 50 adjacent and parallel to roll 51. Element 56 is inclined downwardly from the upper wing member 50 toward the nip between the rolls 23 and 24.

Secured to and projecting horizontally and in cantilever fashion inwardly from the inside surface of the lower wing support 42, and in spaced, parallel relation to and beneath the upper wing member 50 is a lower wing member 60, which like member 50 extends only part way across the opening between walls 12 and 13. Secured to the outer end of member 60 remote from its support member 42 is a sheet metal wing element 66, which is disposed beneath the upper wing element 56 in spaced, registering relation therewith, and which is inclined in the direction opposite to that of element 56, and upwardly toward the nip between the outlet rolls 23 and 24. As shown more clearly in FIG. 3, the wing element 56 is disposed in a plane which is disposed in spaced, parallel relation to a plane containing the upper surface 33 of the gear box 30, while the lower wing element 66 lies in a plane which is disposed in spaced, parallel relation to a plane containing the lower surface 34 on the gear box 30. Although not illustrated in detail herein, it is to be understood that the lower wing member 60 has rotatably mounted therein intermediate its ends four coaxially disposed film guide rollers similar to those denoted at 51 through 54 in the upper wing member 50, except that the four guide rolls in the lower wing 60 are mounted in recesses in wing member 60 which face downwardly, so that the peripheral surfaces of the rolls in wing member 60 face downwardly so that, as noted hereinafter, they guide the lower layer L2 of the film beneath the lower wing member 60.

Figure 4:
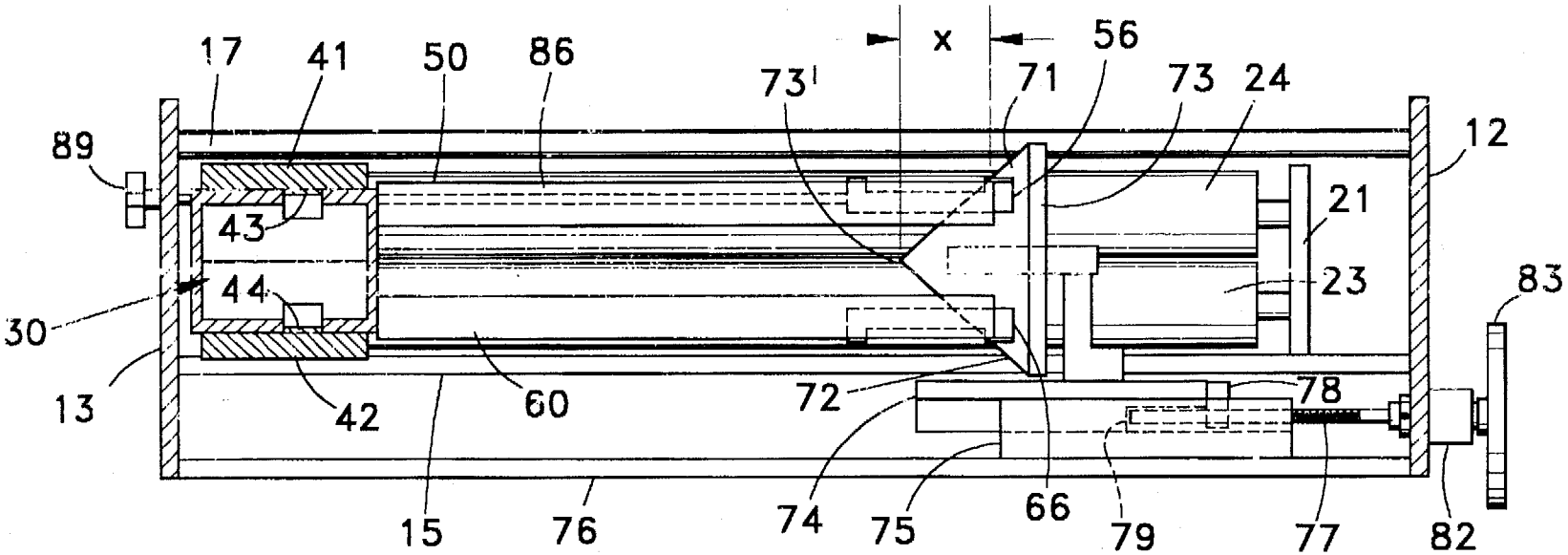
FIG. 4 is a fragmentary sectional view taken generally along the line 4—4 in FIG. 3 looking in the direction of the arrows, but on a slightly smaller scale.

The wing elements 56 and 66 are mounted to have portions thereof remote from wall 13 disposed in overlapping relation to the inclined, intersecting edges 71 and 72 of a triangularly-shaped plate or gusset forming plow 73. Plow 73 is fastened at one side thereof to the forward end of a slide 74 having a dove-tailed lower end which is slidable in a matching way formed in the surface of a block 75 (FIG. 4) that is secured on an elongate, metal strap 76, that extends between sidewalls 12 and 13 adjacent and parallel to the roll supporting strap 15. Slide 74, and hence the plow 73, are adjustable longitudinally along block 75 by an adjusting shaft 77 which has an externally threaded end that threads into a fitting 78 (FIGS. 2 and 4) that is secured to slide 74 coaxially over the outer end of an enlarged-diameter opening 79 in the slide. Adjacent its opposite ends shaft 77 is rotatably journaled as at 81 (FIG. 2) in an opening in wall 12, and has an outer end that extends through a bearing housing 82 at the exterior wall 12 and is fixed to an adjusting knob 83.

In use, the film or web that is to be gusseted is fed to the inlet rolls 25, 26 in its folded form as shown in FIGS. 1 and 2. At this time the overall width of the web entering mechanism 10 is wider than the overall width of the web departing the mechanism at rolls 23, 24 by a value equal to the desired depth or width of the gusset G that is to be formed in the web. In FIGS. 1 and 2 this excess width of the incoming web is denoted at x; and it will be noted that the depth of the gusset G produced by mechanism 10 likewise is of the same value x. Note also that the incoming web is fed into mechanism 10 in such manner that the fold line FL is spaced laterally (to the left of FIG. 1) the distance x beyond the inner ends of arm members 50, 60 and the wing elements 56 and 66 thereon. The inner ends of arm members 50 and 60 are thus also spaced approximately the distance x from the fold line FL. After the folded film passes between the inlet rolls 25 and 26 its upper layer L1 is guided upwardly over the top of the upper wing member 50, and its lower layer L2 is guided downwardly beneath the lower wing member 60. As the layers L1 and L2 pass over the members 50 and 60 portions thereof adjacent opposite sides of the fold line FL first are separated from each other by the upper and lower wing elements 56 and 66, respectively, and then move toward each other as the portions slide along wing elements 56 and 66. At this time the plow 73 is supported by slide 74 in a vertical plane inclined to the path of travel of the folded film, and in such manner that the pointed end 73' of the plow (see FIGS. 2 to 4) extends laterally inwardly a distance x between wing elements 56, 66, and is positioned immediately adjacent to the nip formed between the outlet rolls 23 and 24. As a consequence, as the upper and lower layers of the film pass over the wing elements 56 and 66, and then converge toward the rolls 23 and 24, the vertically disposed portion of the film extending between the spaced wing elements 56 and 66 is engaged medially thereof by the portion of the plow adjacent its pointed end 73', thereby causing portions of the film adjacent opposite sides of its fold line FL to be urged inwardly so as to be overlapped by portions of the outer layers L1 and L2 of the film, thus producing in the film a gusset G and two registering fold lines FL1 and FL2 (FIG. 1) as the film passes through the nip between rollers 23 and 24.

The size of the gusset can be adjusted by adjusting the space between the wing members 50 and 60, and the extent to which the pointed end 73' of the plow 73 extends into the space between the layers L1 and L2 as the latter pass over the plow adjacent its pointed end. For example, assuming that the value x is to be reduced, by rotating the knob 48 in one direction the supports 41 and 42, and hence the members 50 and 60, can be shifted in unison toward the nip between rolls 23 and 24, thus moving the wing elements 56 and 66 closer together, and thereby leaving less film extending transversely of the space between the wing elements 56 and 66, and in turn leaving less film to be urged inwardly by the plow 73. When such adjustments are made to members 50 and 60, it is necessary to adjust the plow 73 by rotating the knob 83 in the direction to withdraw the plow slightly toward the sidewall 12 to prevent undesirable puncturing of the film adjacent its fold line. By accurately adjusting the space between wing members 50 and 60, and the extent to which the pointed end 73' of the plow 73 projects into the film, the depth of the gusset G can be accurately controlled without causing any undesirable wrinkling or tearing of the film as it passes through the mechanism 10.

At certain times the incoming web may exhibit slight misalignment of the two halves of the folded web, or the gusset may be slightly uneven along its top and bottom. It has been discovered that these faults can be corrected by effecting slight lateral adjustment of wing element 56 on member 50. For this purpose an elongate shaft 86 is journaled in a recess in wing member 50 to rotate in spaced, parallel relation to rolls 51-54. Shaft 86 has an externally threaded inner end which threads into an axial bore in the block 57 to which wing element 56 is secured, and an outer end which extends through a diagonal slot 87 in wall 13, and is secured to an adjusting knob 89. By rotating knob 89 slightly in one direction or the other the block 57 and hence wing element 56 can be shifted slightly on member 50 toward or away from the fold line FL of a web passing through mechanism 10.

While this invention has been illustrated and described in detail in connection with only certain embodiments thereof, it will be apparent that it is capable of still further modification, and that this application is intended to cover any such modifications which may fall within the scope of one skilled in the art, and the appended claims.

We claim:

1. A method of forming a gusset of predetermined depth between the two overlapping layers of an elongate non-tubular web of material that is folded about a single fold line extending longitudinally of the folded web medially of its registering, separate longitudinal side edges, comprising causing the folded web to advance from a pair of inlet rolls to a pair of outlet rolls spaced from said inlet rolls, during the initial advance of said web gradually separating the longitudinal side edges and adjacent, registering portions of said web from each other to a distance equal to twice the predetermined depth to which the gusset is to be formed in the web, thereby causing the remaining portions of the web at opposite sides of said fold line initially to extend transversely between the separated portions of said web, thereafter, during the remainder of the advance of the web to the outlet rolls, causing the previously separated adjacent portions of said web gradually to become reengaged, and during the reengagement of said adjacent portions of the web causing said remaining portions of the web to be folded as a gusset progressively inwardly to said predetermined depth between said adjacent portions of the web as they become reengaged.

2. A method as defined in claim 1, including guiding the fold line of said web diagonally inwardly toward the longitudinal side edges of said web a distance equal to said predetermined distance during the passage of said web from said inlet to said outlet rolls.

3. In a bag making machine of the type in which the overlapped halves of an elongate non-tubular web of material, which is folded about a single fold line extending medially of its separable longitudinal side edges, travel from the nip between a pair of inlet rolls to the nip between a pair of outlet rolls spaced from the inlet rolls, a gusset forming mechanism located in the space between said pairs of rolls and comprising, web separating means including a pair of elongate wing members extending in spaced, parallel relation to each other between said overlapped halves of web transversely of said longitudinal side edges thereof, and part way toward said fold line, and having thereon web guiding surfaces operative during travel of said web from said inlet to said outlet rolls initially to effect disengagement and gradual separation of said side edges and adjacent, registering portions of said web a predetermined distance, and then gradual reengagement of said adjacent portions of the web, gusset folding means operative during the gradual reengagement of said adjacent portions of said web to engage and urge said fold line progressively inwardly to a predetermined depth between said adjacent portions of said web, thereby to fold the remaining portions of said web at opposite sides of said fold line progressively inwardly to form a gusset of said predetermined depth between said adjacent portions of said web, and means mounting said wing members for limited movement selectively toward or away from each other thereby selectively to adjust the space between said wing members and said web guiding surfaces thereof.

4. A bag making machine of the type defined in claim 3, wherein each of said wing members has an inner end and an outer end, and has the web guiding surface thereof extending longitudinally therebetween, and said mounting means supports said wing members with the inner ends thereof extending in cantilever fashion transversely inwardly between said side edges and said adjacent portions of said web, and with said web guiding surfaces thereof being engaged by and intially separating said adjacent portions of said web said predetermined distance.

5. A bag making machine as defined in claim 4, wherein said wing member supporting means supports said members in vertically spaced relation, and with said web guiding surface of one of said members facing upwardly and the web guiding surface of the other of said members facing downwardly, whereby during its travel one of said adjacent portions of said web passes over said one wing member and the other adjacent portion of the web passes beneath said other of the wing members.

6. A bag making machine as defined in claim 5, including an upper wing element mounted at one end on said one wing member adjacent said inner end thereof, and extending at its opposite end in overlapping parallel relation to one of said inclined surfaces on said plow, and a lower wing element mounted at one end on said other wing member adjacent said inner end thereof, and extending at its opposite end in overlapping parallel relation to the other of the inclined surfaces on said plow, said adjacent portions of said web being disposed to slide along said wing elements during passage thereof from said wing members to said outlet rolls.

7. A bag making machine as defined in claim 6, including means mounting said one end of said upper wing element on said one wing member for limited adjustment longitudinally of said one wing member.

8. A bag making machine as defined in claim 3, wherein said web guiding surfaces on said wing members are separated said predetermined distance, and said distance is equal to twice said predetermined depth to which said gusset is folded between said adjacent portions of said web.

9. A bag making machine as defined in claim 3, wherein said gusset folding means comprises a plow having thereon two inclined web guiding surfaces which intersect at a pointed end of the plow, and means mounting said plow adjacent said inner ends of said wing members with said inclined surfaces of the plow extending diagonally of the path of travel of said web, and inwardly between said remaining portions of said web to position said pointed end thereof.

10. A bag making machine as defined in claim 9, wherein said mounting means for said wing members includes means mounting the outer end of one of said members for adjustment toward and away from said outlet rolls along a path parallel to one of said inclined surfaces on said plow, means mounting the outer end of the other of said members for adjustment toward and away from said outlet rolls along a path parallel to the other of said inclined surfaces on said plow, and means for effecting simultaneous adjustment of said members and selectively in opposite directions along said paths thereby to adjust the space between said members.

11. A bag making machine as defined in claim 3 wherein each of said wing members has rotatably mounted in an elongate recess in one surface thereof a plurality of coaxially aligned rollers the peripheral surfaces of which project in part beyond said one surface to define said web guiding surface for a respective wing member, and said wing member mounting means supports said members in vertically spaced relation with said one surfaces thereof facing in opposite directions.

12. In a bag making machine of the type in which the overlapped halves of an elongate non-tubular web of material, which is folded about a fold line extending medially of its longitudinal side edges, travel from the nip between a pair of inlet rolls to the nip between a pair of outlet rolls spaced from the inlet rolls, a gusset forming machanism located in the space between said pairs of rolls and comprising, web separating means including a pair of elongate wing members extending in spaced, parallel relation to each other between said overlapped halves of web transversely of said longitudinal side edges thereof, and part way toward said fold line, and having thereon web guiding surfaces operative during travel of said web from said inlet to said outlet rolls initially to effect disengagement and gradual separation of said side edges and adjacent, registering portions of said web a predetermined distance, and then gradual reengagement of said adjacent portions of the web, gusset folding means operative during the gradual reengagement of said adjacent portions of said web to engage and urge said fold line progressively inwardly to a predetermined depth between said adjacent portions of said web, thereby to fold the remaining portions of said web at opposite sides of said fold line progressively inwardly to form a gusset of said predetermined depth between said adjacent portions of said web, means mounting said wing members for limited movement selectively toward or away from each other thereby selectively to adjust the space between said wing members and said web guiding surfaces thereof, said gusset folding means comprising a plow having thereon two inclined web guiding surfaces which intersect at a pointed end of the plow, means mounting said plow adjacent said inner ends of said members with said inclined surfaces of the plow extending diagonally of the path of travel of said web, and inwardly between said remaining portions of said web to position said pointed end thereof in engagement with said fold line of the web, and said plow mounting means including means for adjusting said plow selectively to increase or decrease the depth to which said pointed end of the plow extends inwardly between said remaining portions of the web.

13. A bag making machine as defined in claim 12, wherein said plow is generally triangularly shaped in configuration, and said adjusting means for said plow is operable to shift said pointed end of the plow along a line registering with and extending parallel to the nip between said outlet rolls.

* * * * *